United States Patent [19]

Boersma

[11] 3,952,432

[45] Apr. 27, 1976

[54] MECHANISM FOR MOVING SCRAPER BOWL EJECTOR BLADE

[75] Inventor: Richard F. Boersma, Springfield, Ill.

[73] Assignee: Fiat-Allis Construction Machinery, Inc., Deerfield, Ill.

[22] Filed: Aug. 5, 1974

[21] Appl. No.: 494,812

[52] U.S. Cl. ..... 37/126 AE; 91/411 R

[51] Int. Cl.[2] ..... E02F 5/00

[58] Field of Search..... 37/126 AE, 126 AB, 117.5; 91/411 R

[56] References Cited

UNITED STATES PATENTS

| | | | |
|---|---|---|---|
| 2,353,120 | 7/1944 | Austin | 37/126 AE |
| 2,554,930 | 5/1951 | Ulinski | 91/411 R X |
| 2,886,197 | 5/1959 | Harris | 91/411 R X |

*Primary Examiner*—Stephen C. Pellegrino
*Attorney, Agent, or Firm*—Thomas F. Kirby; Robert A. Brown

[57] ABSTRACT

A motor scraper has a dozer-type ejector blade which is forwardly movable to eject earth from the scraper bowl by an operating mechanism which includes a movable carriage having three hydraulic rams mounted thereon. The ram cylinders are rigidly connected in parallel physical arrangement on the carriage. The piston rods of two rams are pinned to the ejector blade and the rod of the remaining ram is pinned to the scraper frame. The blade and carriage are initially disposed in their rearward positions. To move the blade forward to eject earth from the bowl, pressurized hydraulic fluid is supplied simultaneously to all ram cylinders to initially cause the said two rams to extend fully and move the blade part way forward (while the said one ram causes the carriage to remain stationary) and to then subsequently cause the said one ram to extend fully and move the carriage forward and thereby cause the blade to move all the way forward. The initial forward blade movement (which occurs while the bowl is full) is carried out with high force at low speed, whereas the subsequent forward blade movement (which occurs after the bowl is partially emptied) is carried out with lower force but at higher speed.

7 Claims, 6 Drawing Figures

MECHANISM FOR MOVING SCRAPER BOWL EJECTOR BLADE

BACKGROUND OF THE INVENTION

1. Field of Use

This invention relates generally to motor scrapers and in particular to mechanisms for moving an ejector blade in the bowl of such scrapers.

2. Description of the Prior Art

A motor scraper typically comprises a tractor unit having engine-driven ground engaging wheels and a scraper unit having a supporting frame on which ground engaging wheels and a scraper bowl are mounted. The bowl comprises a bottom wall, laterally spaced apart side walls and a rear wall and is adapted to receive and contain earth which enters the bowl from the front thereof as the scraper unit is drawn across a job site by the tractor unit. Emptying of the bowl is facilitated by a generally vertically disposed dozer type ejector blade which is located at (or sometimes defines) the rear wall of the bowl and is movable forwardly horizontally across the bowl bottom between the side walls by a suitable blade moving mechanism. Some blade moving mechanisms comprise one or more hydraulic rams, each having a relatively movable cylinder and piston rod, and the ram is connected by a suitable linkage between the ejector blade and some sturdy relatively fixed portion of the scraper unit, such as the ground wheel axle. In such prior art mechanisms each ram reaches an excessive overall length when fully extended to effect full forward travel of the ejector blade. Furthermore, the ram or rams extend at uniform speed and with uniform force.

SUMMARY OF THE INVENTION

In accordance with the invention there is provided a motor scraper which comprises a tractor unit having engine-driven ground engaging wheels and a scraper unit having a supporting frame on which ground engaging wheels and a scraper bowl are mounted. The bowl comprises a bottom wall, laterally spaced apart side walls and a rear wall defined by a generally vertically disposed horizontally movable dozer-type ejector blade. The bowl is adapted to receive and contain earth or other material which enters the bowl at the front thereof as the scraper unit is drawn across a job site by the tractor unit. Emptying of the bowl is facilitated by the ejector blade initially located at the rear of the bowl which is moved forward across the bowl bottom by an ejector blade moving mechanism in accordance with the invention. The mechanism also operates to return the blade to the original position. The mechanism includes a carriage supported for forward and rearward movement by rollers on tracks mounted on the scraper support frame. The mechanism further includes three extendable and retractable hydraulic rams mounted on the carriage in parallel physical arrangement, and with their axes parallel to the path of blade movement. Each ram comprises a ram cylinder and a relatively extendable and retractable ram piston rod. Each ram cylinder is connected to the carriage, whereas the rods of two outermost rams are connected as by pins to the ejector blade and the rod of the innermost remaining ram is connected as by a pin to the scraper frame. When the ejector blade is to be moved forwardly to eject material from the bowl, pressurized fluid from a suitable source is supplied simultaneously to the appropriate side of all three ram cylinders to initially cause the said two rams to extend fully and move the blade part way forward (while the said one ram causes the carriage to remain stationary) and to then subsequently cause the said one ram to extend fully and move the carriage and thereby cause the blade to move all the way forward. The initial forward blade movement (which occurs while the bowl is full) is carried out with high force at low speed, whereas the subsequent forward blade movement (which occurs after the bowl is partially emptied) is carried out with lower force but at higher speed.

An ejector blade moving mechanism in accordance with the invention offers several advantages. For example, the total distance the ejector blade moves is actually the sum of the distance two piston rods are extended. Therefore, shorter rams may be used than in conventional ejector blade moving mechanisms, thereby avoiding the problem of window-locking and ram damage sometimes associated with excessively extended rams. Then too, because of the physical arrangement and hydraulic connection of the rams, greater blade force is available when needed during an ejecting operation, i.e., when the bowl is full, whereas lesser blade force but greater blade speed is available when required, i.e., when the bowl is partially emptied.

DRAWINGS

DESCRIPTION OF A PREFERRED EMBODIMENT

Figure 1:
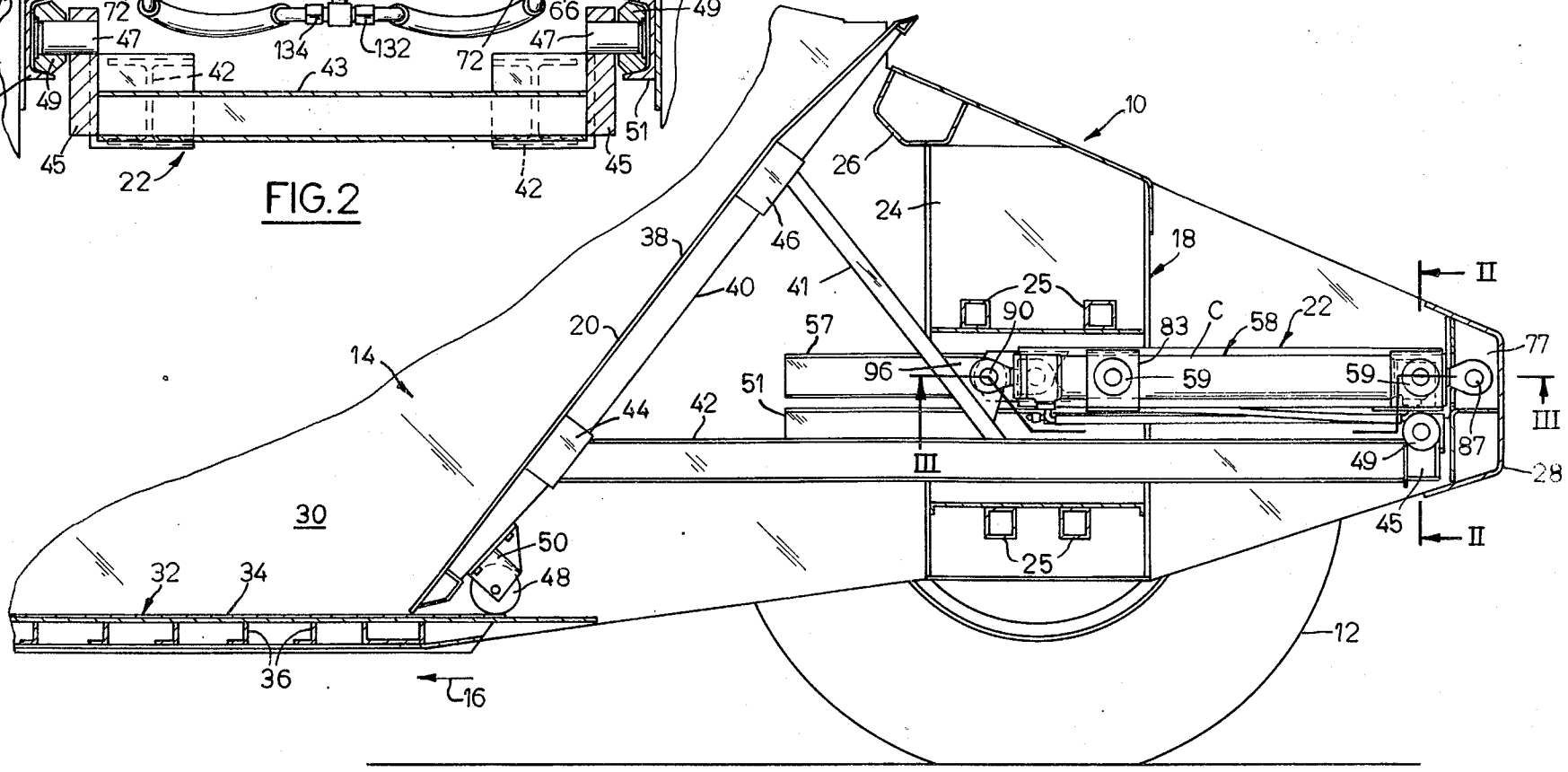
FIG. 1 is a side elevation view, partly in section, of the rear end of a scraper unit of a motor scraper and shows the bowl, the ejector blade and an ejector blade moving mechanism in accordance with the invention.

Referring to FIG. 1, there is shown a cross-section view through the rear portion of a scraper unit 10 having ground wheels 12 and a bowl 14 and of the type that is adapted to be drawn over a job site in the direction of an arrow 16 by an engine-driven tractor unit (not shown) to scrape up earth or other material into the bowl. Scraper unit 10 generally comprises a supporting framework 18 on which are mounted the pair of laterally spaced ground engaging rubber-tired wheels 12 (only one of which is shown), the scraper bowl 14, a horizontally movable dozer-type ejector blade 20 and an ejector blade operating mechanism 22 hereinafter described.

Supporting framework 18 could take any practical form but is shown as comprising a pair of laterally spaced apart vertically disposed rigid side members 24 (shown in FIGS. 1 and 2), suitable rigid cross braces or spacers such as 25 and 26 between the side members, and a laterally disposed rigid rear frame member 28. Framework 18 affords support for laterally spaced apart heavy sheet metal plates such as 30 which define the sides of scraper unit 10 and the laterally spaced apart side walls of bowl 14.

The scraper bowl 14 into which earth is scraped is defined by the side plates or walls 30, by a bottom wall 32 comprising one or more sheet metal upper plates 34 reinforced and supported by angle iron members 36 disposed therebelow and extending between the side walls 30, and by the generally vertically disposed (but forwardly sloped) ejector blade 20.

Figure 2:
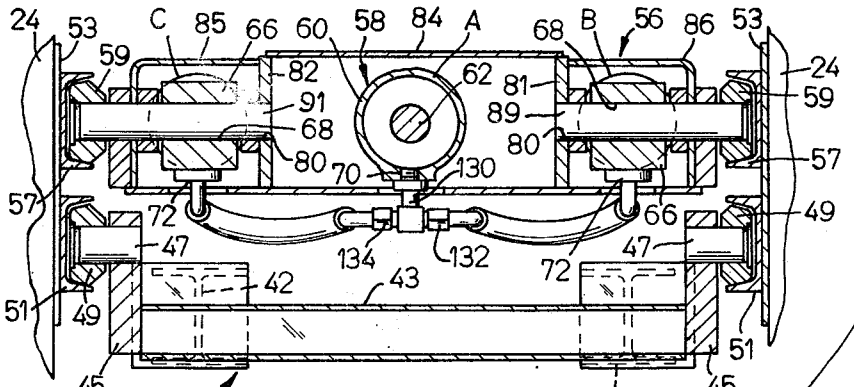
FIG. 2 is an enlarged cross-section view of the ejector blade moving mechanism taken on line II—II of FIG. 1.

Blade 20 takes the form of a sheet metal plate 38 reenforced on its rear side by generally vertically disposed reenforcing members 40 welded thereto. Blade 20 is supported by a pair of laterally spaced apart longitudinally disposed I-beams 42 (both shown in FIG. 2) which are welded at their forward ends to brackets 44 on the members 40. Blade 20 is further supported and rigidified by a pair of laterally spaced apart angularly disposed braces 41 (only one of which is shown) which are welded between brackets 46 on the members 40 and the beams 42. As FIG. 2 shows, the beams 42 are joined near their rearward ends by a rigid cross brace 43 welded therebetween and roller support brackets 45 are provided at opposite ends of cross brace 43. Each bracket 45 supports a pin or axle 47 on which a roller 49 is rotatably mounted. The rollers 49 are engageable with or ride in the grooves in tracks 51 which are secured as by welding to track assembly plates 53 which, in turn, are rigidly secured to the side members 24. The rollers 49 facilitate fore and aft movement of blade 20 and its associated support beam 42, all of which move as a unit. Blade 20 is provided with a plurality of blade support wheels 48 (only one of which is shown in FIG. 1) which are rotatably mounted on wheel support brackets 50 secured to the reenforcing members 40. The blade support wheels 48 ride on bottom wall 32 of bowl 14 and facilitate movement of blade 20 thereacross in the fore and aft directions.

Figure 4:
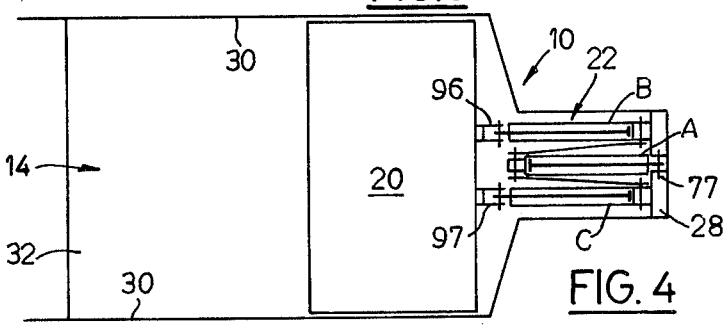
FIG. 4 is an elementary schematic top plan view of the scraper unit and shows the relative positions of the bowl, the ejector blade, the carriage and rams at the start of an ejecting operation or cycle.
Figure 5:
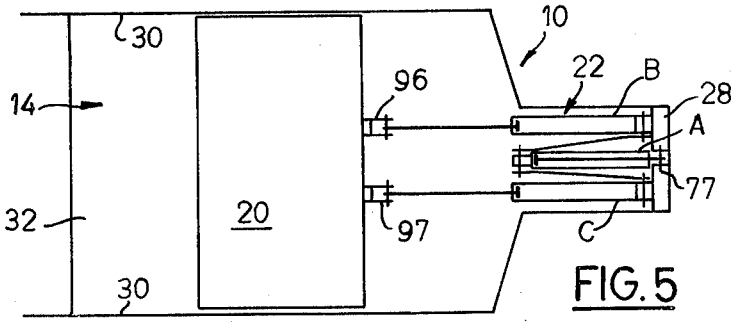
FIG. 5 is a view similar to FIG. 4 but showing the relative position of the components part way through an ejecting operation or cycle when the ejector blade is partially advanced.
Figure 6:
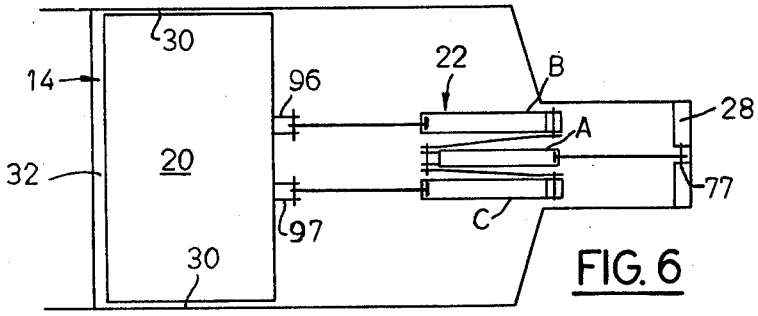
FIG. 6 is a view similar to FIGS. 4 and 5 but showing the relative position of the components at the end of an ejecting operation or cycle when the ejector blade is fully advanced.

FIGS. 1 and 4 show blade 20 in its rearwardmost or fully retracted position, i.e., that position wherein it is normally disposed while scraper unit 10 is performing a scraping operation, and wherein it defines the rear wall of bowl 14. FIG. 5 shows blade 20 advanced part way toward its fully extended ejecting position. FIG. 6 shows blade 20 advanced all the way to its fully extended ejecting position. Blade 20 is movable to the position shown in FIGS. 4, 5 and 6 by the ejector blade operating mechanism 22.

Figure 3:
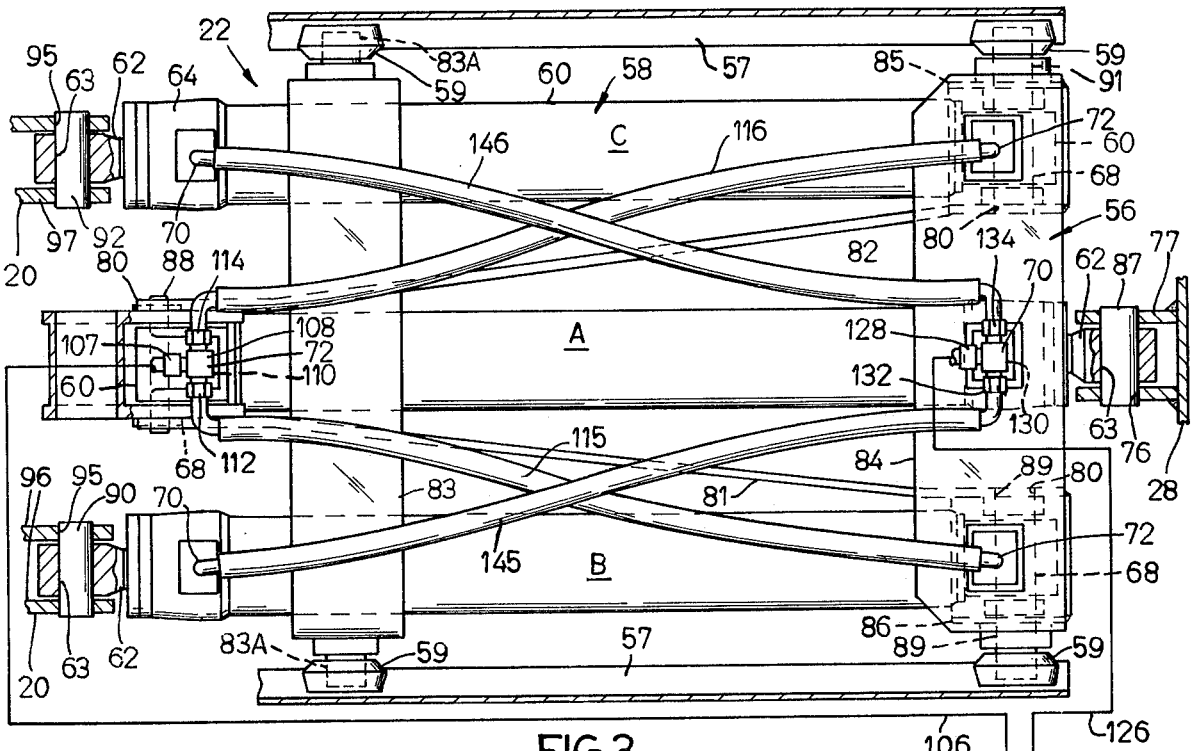
FIG. 3 is a bottom plan view, partly in section, of the ejector blade moving mechanism taken on line III—III of FIG. 1.

Referring to FIGS. 1, 2 and 3, operating mechanism 22 generally comprises a movable carriage or frame 56 and three hydraulic rams A, B and C mounted on the carriage. Carriage 56 is mounted by means of four rollers 59 for fore and aft travel on laterally spaced apart guide tracks 57 secured to the track assembly plates 53. Carriage 56 generally comprises two longitudinally disposed rigid carriage frame members 81 and 82, two transverse support members 83 and 84, sheet metal protective covers 85 and 86, and a plurality of pins hereinafter identified and described. The transverse support member 83 is provided with stub shafts or axles 83A at opposite ends thereof on which the pair of forward rollers 59 are rotatably mounted and engageable with the guide tracks 57.

Each ram A, B, C comprises a cylinder 58, a piston 60 slidably movable within the cylinder, and a piston rod 62 connected to the piston and extending through rod seal means 64 at the rod end of the cylinder. Each piston rod 62 is provided with a pin hole 63 at its outermost end. The base end of each cylinder 58 is provided with a rigidly attached block 66 having a pinning hole 68 therethrough. Each cylinder 58 is also provided with fluid ports or fittings 70 and 72 at its base end and rod end, respectively.

Ram A is centrally located and has its rearwardly disposed piston rod 62 pinned to a bracket 77 which is rigidly secured to the scraper rear frame member 28 by pin 87 which extends through pin hole 63 in the rod and through pin holes 76 in bracket 77. The base end of ram A is pinned to carriage 56 by a pin 88 which extends through pin hole 68 in the cylinder and through pin holes 80 in the forward ends of the carriage frame members 81 and 82.

Rams B and C are located on opposite sides of and parallel to ram A and are reversely disposed with respect to ram A. Ram B has the rearwardly disposed end of its cylinder 58 pinned to the rear end of carriage 56 by pin 89 which extends through pin hole 68 in the cylinder and through pin hole 80 in the rear end of carriage frame member 81. Pin 89 also supports a rear roller 59. Ram B has its forwardly disposed piston rod 62 pinned to the blade assembly by a pin 90 which extends through pin hole 63 in the rod and through pin holes 95 in a bracket 96 which is rigidly secured to one ejector blade brace 41.

Ram C has the rearwardly disposed end of its cylinder 58 pinned to the rear end of carriage 56 by pin 91 which extends through pin hole 68 in the cylinder and through pin hole 80 in the rear end of carriage frame member 82. Pin 91 also supports a rear roller 59. Ram C has its forwardly disposed piston rod 62 pinned to the blade assembly by a pin 92 which extends through pin hole 63 in the rod and through pin holes 95 in a bracket 97 which is rigidly secured to the other ejector blade brace 44.

As FIG. 3 shows, the rams A, B and C are connected in a parallel hydraulic circuit so that pressurized hydraulic fluid from a pump P which is driven by a motor M may be supplied by selective operation of a three-position variable flow valve V to all three rams A, B and C simultaneously to ultimately effect extension or retraction of blade 20, as hereinafter explained. More specifically, fluid from a reservoir R is supplied through a fluid supply line 100 to pump P which is connected by a fluid pressure line 102 to control valve V. Valve V is connected by a fluid return line 104 to reservoir R. A fluid line 106 is connected between valve V and the fluid port 72 at the rod end of the cylinder 58 of each ram A, B, C. More specifically, line 106 connects to a port 107 of a connector 108 which has three other ports 110, 112 and 114 which are connected as follows. Port 110 connects to port 72 of ram A; port 112 connects to port 72 of ram B through hose 115; and port 114 connects to port 72 of ram C through hose 116.

A fluid line 126 is connected between valve V and the fluid port 70 at the base end of the cylinder 58 of each ram A, B, C. More specifically, line 126 connects to a port of a connector 128 which has three other ports 130, 132 and 134 which are connected as follows. Port 130 connects to port 70 of ram A; port 132 connects to port 70 of ram B through hose 145; and port 134 connects to port 70 of ram C through hose 146.

With ram A in its closed or retracted position, as shown in FIGS. 1 and 3, the carriage 56 also makes contact with rear frame 28 of scraper 10. With the rams A, B and C hydraulically connected in parallel, unit hydraulic pressure supplied from pump P to the cylinders 58 of rams B and C by operation of valve V imposes twice as much force to the carriage 56 as is imposed by the unit pressure in cylinder 58 of ram A, thus holding the carriage 56 against the scraper rear frame 28. An equal and opposite force from the rams B and C is imposed on the ejector brackets 96 and 97, until the end of the stroke is reached on rams B and C. When the stroke of rams B and C has reached the maximum, only the force imposed against the carriage 56 at pin 88 by ram A is transferred to the ejector blade 20 through the rams B and C to the ejector brackets 96 and 97. This force, although variable with the hydraulic pressure and ejector resistance, will continually be applied until ram A has reached its extreme extended length. With constant hydraulic flow feeding into the hydraulic circuit, the first half portion of ejector blade travel (shown in FIG. 5) actuated by rams B and C, will be one-half the speed of the second half portion of ejector blade travel when only ram A actuates the movement of the ejector blade 20.

I claim:

1. In a machine including a supporting frame and a component movable with respect to said frame to perform a function, said component being movable from a retracted position to a fully extended position, a carriage mounted on said frame for movement with respect to said frame between a retracted position and an extended position, a plurality of extendable and retractable hydraulic rams mounted on and movable with said carriage, at least two of said rams being connected to said component, and at least another of said rams being connected to said frame, said two rams embodying a total effective piston area greater than that of said other ram, and means including a plurality of fluid lines interconnecting said rams and movable with said carriage to supply pressurized fluid simultaneously to all of said rams while said rams are retracted and said carriage is in retracted position to initially cause said two rams to exert more force than said other ram and to extend fully and move said component from retracted position part way toward fully extended position while said carriage remains in retracted position and to subsequently cause said other ram to extend fully and move said carriage from retracted position to extended position and thereby cause said component to move further to fully extended position.

2. A machine according to claim 1 wherein said component is moved by said two rams from retracted position part way toward fully extended position with a predetermined force at a predetermined speed and wherein said component is moved further by said other ram to fully extended position with less than said predetermined force but at a speed greater than said predetermined speed.

3. In a scraper having a bowl and an ejector blade for ejecting material from said bowl, said blade being movable from a retracted position to a fully extended position, a carriage mounted on said scraper for movement with respect to said bowl between a retracted position and an extended position, a plurality of extendable and retractable hydraulic rams mounted on said carriage, at least two of said rams being connected to said blade, and at least another of said rams being connected to said scraper, and means to supply pressurized fluid simultaneously to all of said rams while said rams are retracted and said carriage is in retracted position to initially cause said two rams to extend fully and move said blade from retracted position part way toward fully extended position while said carriage remains in retracted position and to subsequently cause said other ram to extend fully and move said carriage from retracted position to extended position and thereby cause said blade to move further to fully extended position.

4. A scraper according to claim 3 wherein said two rams embody a total effective piston area greater than that of said other ram and exert more force than said other ram whereby said blade is moved by said two rams from retracted position part way toward fully extended position with a predetermined force at a predetermined speed and wherein said component is moved further by said other ram to fully extended position with less than said predetermined force but at a speed greater than said predetermined speed.

5. In a scraper having a bowl and an ejector blade for ejecting material from said bowl, said blade being movable from a retracted position to a fully extended position, a carriage mounted on said scraper for movement with respect to said bowl between a retracted position and an extended position, a plurality of hydraulic rams, each ram comprising a cylinder and a relatively extendable and retractable piston rod, the cylinders of said rams being mounted on said carriage, two of said rams having their piston rods connected to said blade, and at least another of said rams having its piston rod connected to said scraper, and means to supply pressurized fluid simultaneously to the cylinder of all of said rams while said rams are retracted and said carriage is in retracted position to initially cause said two rams to extend fully and move said blade from retracted position part way toward fully extended position while said carriage remains in retracted position and to subsequently cause said other ram to extend fully and move said carriage from retracted position to extended position and thereby cause said blade to move further to fully extended position.

6. A scraper according to claim 5 including carriage guide rail means on said scraper and roller means connected to said carriage and engageable with said carriage guide rail means to facilitate movement of said carriage.

7. A scraper according to claim 6 including ejector blade guide rail means on said scraper and roller means connected to said ejector blade and engageable with said ejector blade guide rail means to facilitate movement of said ejector blade.

* * * * *